United States Patent [19]

Waldron

[11] Patent Number: 4,467,746

[45] Date of Patent: Aug. 28, 1984

[54] ANIMAL MUGGER

[76] Inventor: Curtis R. Waldron, Rte. 3, Box 2793, Okeechobee, Fla. 33472

[21] Appl. No.: 414,801

[22] Filed: Sep. 3, 1982

[51] Int. Cl.[3] ..... A61D 3/00

[52] U.S. Cl. ..... 119/99; 119/103

[58] Field of Search ..... 119/99, 98, 103, 96

[56] References Cited

U.S. PATENT DOCUMENTS

| | | | |
|---|---|---|---|
| 125,120 | 4/1872 | Cox | 119/99 |
| 2,848,977 | 8/1958 | Prestrud et al. | 119/99 |
| 3,092,871 | 6/1963 | Marshall et al. | 119/99 |

*Primary Examiner*—Jay N. Eskovitz

*Attorney, Agent, or Firm*—Carroll F. Palmer

[57] ABSTRACT

A mugger for use with an animal chute to immobilize the head of an animal held within the chute includes a pair of slotted elongated tubular members that are fixed to the exit gate of the chute with the slots facing outward. Bracket members are moved vertically in the slots by a piston and cable arrangement. A sling suspended between the bracket members moves from a position resting on the ground adjacent the exit gate to a elevated position to engage the head of the animal held in the chute for tagging, treatment or the like.

5 Claims, 8 Drawing Figures

ANIMAL MUGGER

BACKGROUND OF THE INVENTION

1. Field of the Invention

This invention relates broadly to equipment for use in the tagging, medicinal treatment or like handling of cattle or other animals. More particularly, it concerns devices for attachment to animal chutes that can immobilize the head of an animal held in the chute for treatment.

2. Description of the Prior Art

From time to time, cattle and other domestic animals must be treated with medicinals, ear tagged, or subjected to various other treatments. To accomplish this cattle chutes have been developed to hold the animal so the treatment can be safely accomplished. Typically, the chutes comprise a pair of sides plus entrance and exit gates that pivot from an open position where the animal may be lead into the chute to a closed position where the chute sides clamp against the sides of the animal and its head extends through an opening in the exit gate. Animal chutes of this type have been commercially available for many years for use by ranchers, veterinarians, etc. (see for example "The Florida Cattleman and Livestock Journal" Vol. 46, No. 6, March 1982, pages 14, 36, 50 and 113, the disclosure of which in incorporated herein by reference).

Although the person administering the treatment, tagging, etc. is isolated from the legs and body of the animal by the closed chute, the animal is still able to move its head about. Hence, it is necessary to immobilize the head to effectively apply the treatment. In the past this has been done by stationing a person at the exit gate of the chute to physically grab hold of the animal's horns or other portion of its head to hold the head still while another person applies the treatment. The person holding the animal's head is known in the trade as a "mugger". The present invention provides a mechanical device to perform the job of the mugger thereby performing the head holding task more effectively and, at the same time, eliminating the cost of the human mugger in the animal treatment operation.

In the slaughtering of animals, it has been known to use piston operated devices to hold the heads of animals still with the throat exposed so the animal may be slaughtered (see U.S. Pat. Nos. 3,087,195; 3,092,871 and 3,101,508). However, there is a critical difference between these prior art devices and those of the present invention. Thus, in the devices of this invention, it must be possible for the animal to walk out the chute after its treatment has been applied, whereas, in the prior devices when the animal has been slaughtered, the dead body, either in one piece or cut into sections, is hoisted out of the chute by an overhead meathook or the like so there are no exit gates on the slaughter chutes.

OBJECTS

A principal object of the present invention is the provision of new forms of animal treatment devices.

Further objects include the provision of:

1. New equipment to immobilize the heads of cattle or other animals held in a chute for tagging, medicinal treatment or the like.

2. Animal handling equipment that eliminates the need to employ a person known as a "mugger" in the tagging, medicinal treatment, etc. of cattle or other animals in a holding chute.

3. A mechanical mugger that may be attached to cattle chutes to replace the humans used in the past to immobilize the cattle's head during treatment in the chute.

4. New methods for mugging cattle held in a chute in the course of treating, tagging, etc. of the cattle.

Other objects and further scope of applicability of the present invention will become apparent from the detailed description given hereinafter; it should be understood, however, that the detailed description, while indicating preferred embodiments of the invention, is given by way of illustration only, since various changes and modifications within the spirit and scope of the invention will become apparent to those skilled in the art from this detailed description.

SUMMARY OF THE INVENTION

These objects are accomplished in part by the provision of a mechanical animal mugger which comprises first and second elongated tubular members, a longitudinal slot in each of the tubular members, means to mount the tubular members vertically on the outside of the exit gate of an animal chute with the slots facing away from the exit gate, a first bracket member structured to slide vertically in the slot of one of the tubular members, a second bracket member structured to slide vertically in the slot of the second of the tubular members, a sling member fixed to the bracket members so the sling member may be moved by the bracket members from a position resting on the ground adjacent the exit gate of the animal chute to a elevated position to engage the head of an animal held in the chute, and means to move the bracket members vertically along the tubular members.

In the preferred embodiments the means to move the bracket members comprises a piston and the piston pulls cables around a plurality of sheaves to move the bracket members.

BRIEF DESCRIPTION OF THE DRAWINGS

A more complete understanding of the invention may be had by reference to the accompanying drawings in which.

DESCRIPTION OF THE PREFERRED EMBODIMENTS

With reference to the accompanying drawings in which like parts are identically numbered, the equipment 2 comprises an animal chute 4 constructed in accordance with the prior art and a mechanical mugger 6 constructed in accordance with the present invention.

Figures 1, 2, 3, 4:
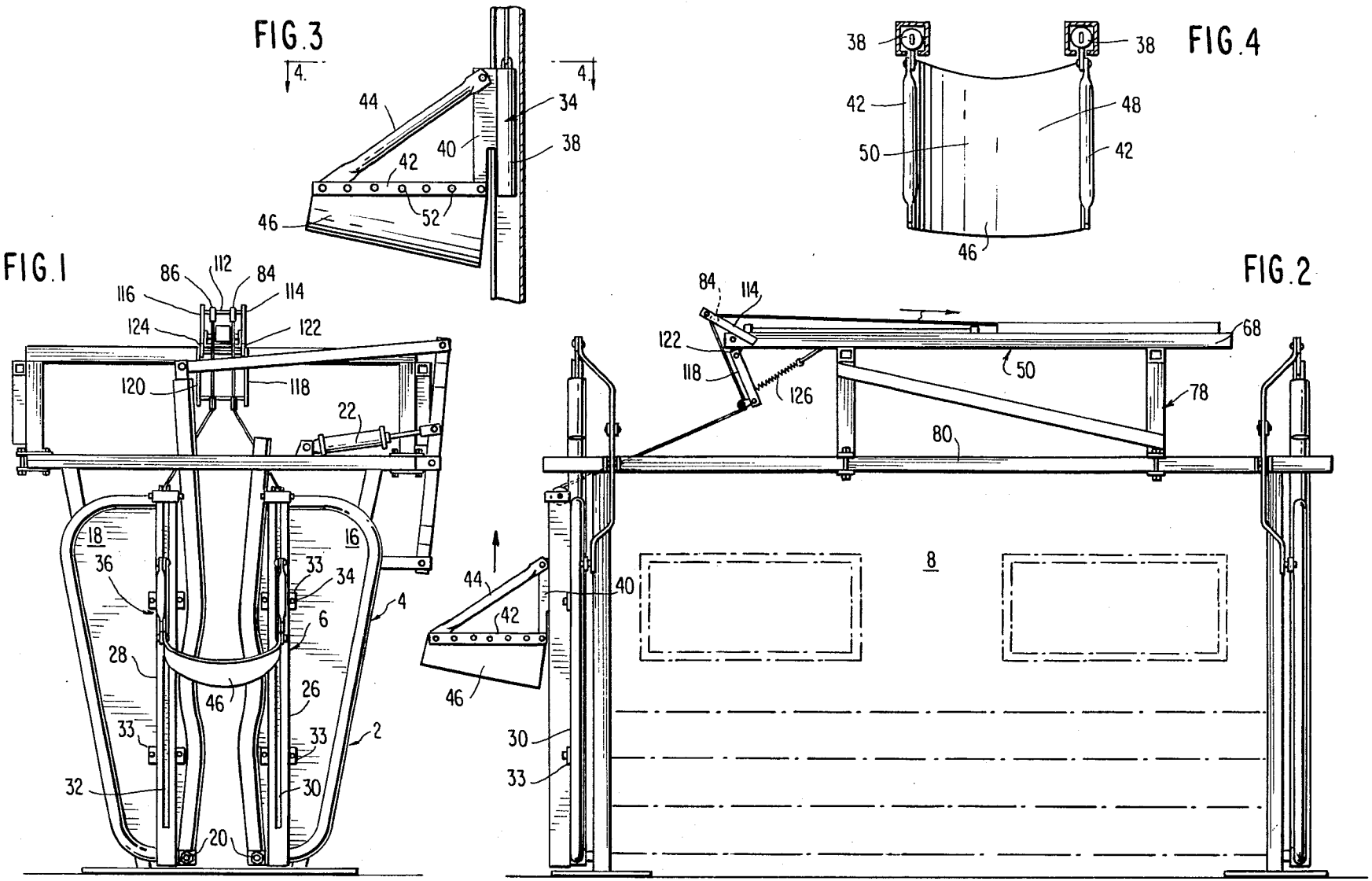
FIG. 1 is an elevational view of the exit gate of an animal chute to which is attached an animal mugger of the invention with the chute is its closed position.
FIG. 2 is a lateral view of the equipment shown in FIG. 1.
FIG. 3 is a fragmentary, lateral view of the sling section of the animal mugger of the invention.
FIG. 4 is a sectional view taken on the line 4—4 of FIG. 3.
Figure 5:
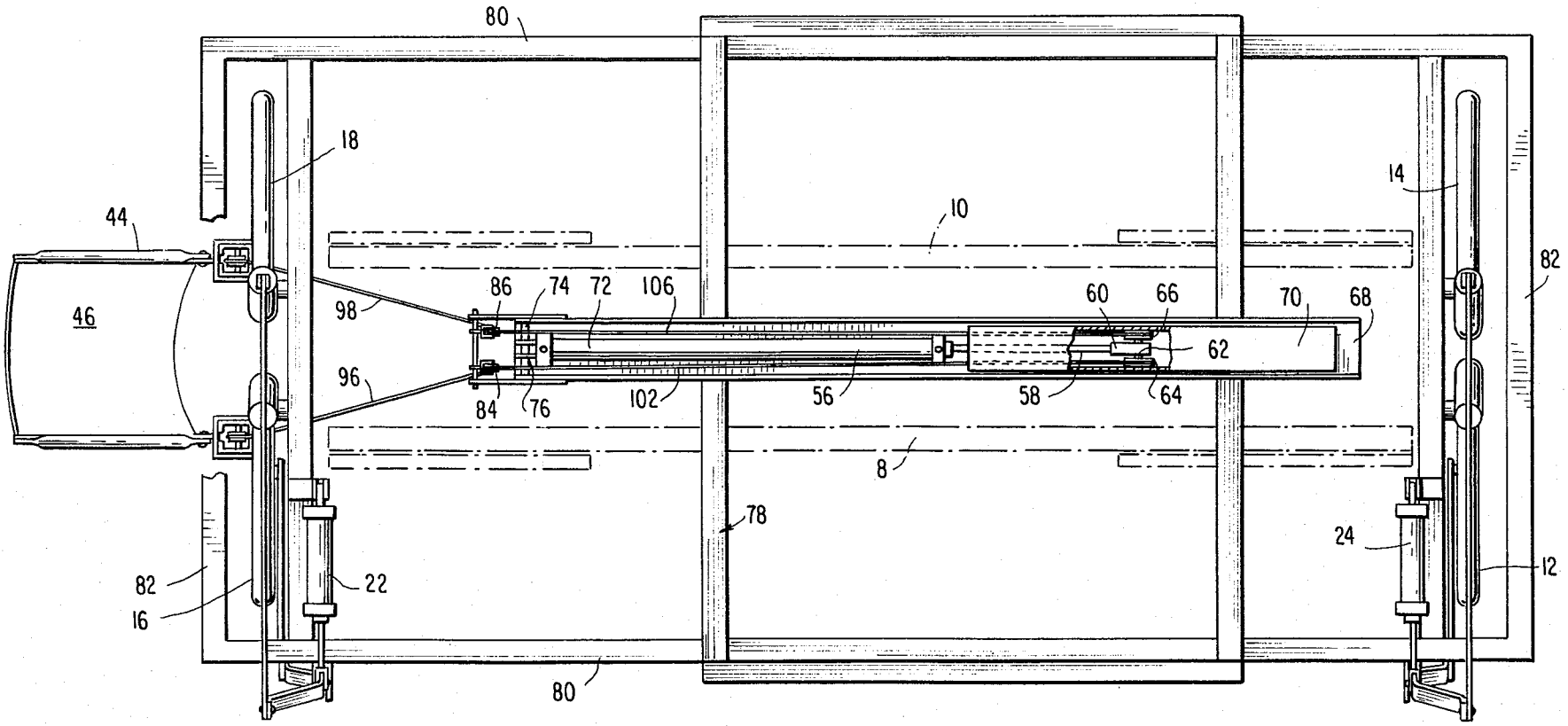
FIG. 5 is a plan view of the equipment shown in FIG. 1.

The chute 4 comprises sides 8 and 10, an entrance gate formed of the two sections 12 and 14 and an exit gate formed of the two sections 16 and 18. The gate sections 16 and 18 are pivoted on bolts 20 for movement by piston means 22 between an opened position (see FIG. 6) and a closed position (see FIG. 1). The gate sections 12 and 14 are similarly pivoted (not shown) for movement by the piston means 24.

The mechanical mugger 6 comprises a first elongated tubular member 26 and a second elongated tubular member 28 provided with longitudinal slots 30 and 32. The members 26 and 28 are fixed to the gate sections 16 and 18 respectively by the lugs 33 with the slots 30 and 32 facing away from the sections 16 and 18.

Bracket members 34 and 36 are structured to slide vertically in the slots 30 and 32 respectively. The bracket members 34 and 36 each comprise a weight 38, a plate 40 fixed to the weight 38, an extension 42 carried by the plate 40 and a brace 44 joined to the extension 42 and plate 40. The weights 38 are of a size that fit inside the tubular members 34 and 36.

A sling 46 is fixed at its sides 48 and 50 to the bracket extensions 42 by bolts 52 to slope downward toward the tubular members 26 and 28. Preferably, the sling 46 is made of ¼ in. thick fabric, e.g., a combination of nylon and rubber such as used for conveyor belts. Such fabric has been found to be able to withstand the abuse it receives from cattle exiting the chute.

The bracket members 34 and 36 and the attached sling member 46 are moved by the means 50 that comprises piston means 52 and cable means 54.

The piston means 50 includes a cylinder 56, piston rod 58 and lines (not shown) connecting the cylinder 56 to a fluid pressure source to move the piston rod in and out of the cylinder 56. The free end 60 of piston rod 58 carries the rod 62 to which journals a pair of sheaves 64 and 66. The cylinder 56 and piston rod 58 rest in the channel 68 and the free end 60 of the rod 58 reciprocates in a tunnel defined the a second, shorter channel 70. The rear end 72 of cylinder 56 is fixed to the pin 74 via the clevis 76. The channel 68 and related items are supported above the chute 4 by framework 78 which, in turn, is supported by the longitudinal beams 80 and cross beams 82.

The cable means 54 includes a second pair of sheaves 84 and 86, a third pair of sheaves 88 and 90, sheaves 92 and 94 journalled on the top ends of the tubular members 26 and 28 respectively and a pair of cables 96 and 98.

Figure 8:
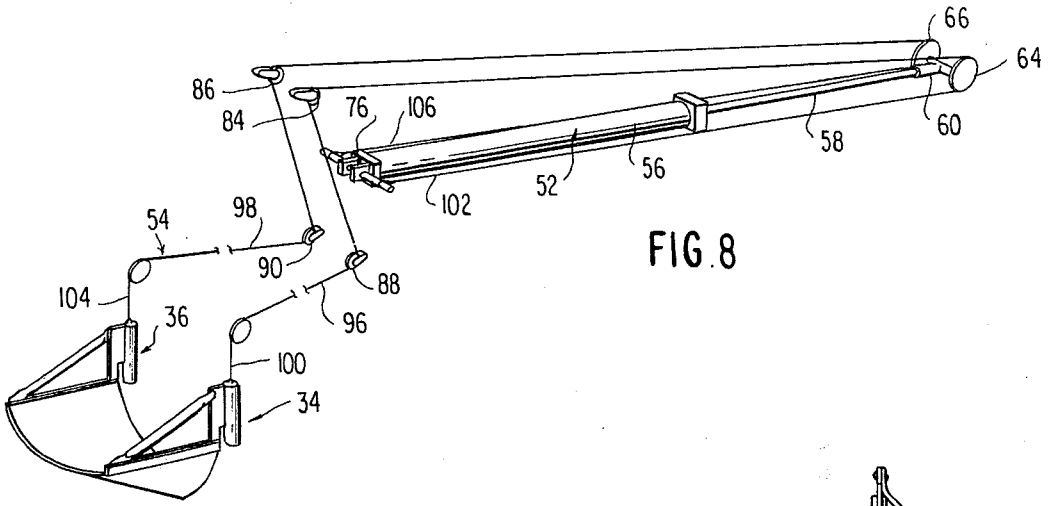
FIG. 8 is a schematic of the mugger actuation elements of the invention.
Figure 7:
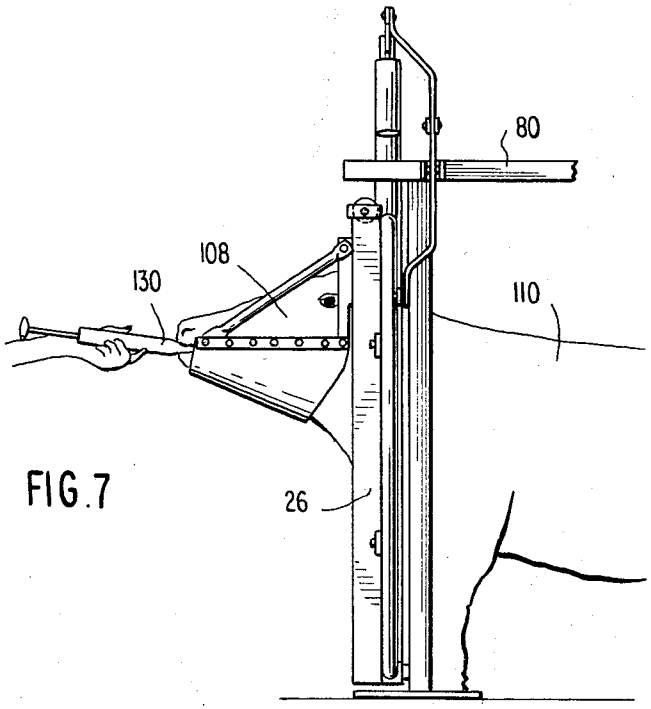
FIG. 7 is a fragmentary, lateral view of the equipment of FIG. 1 with a cattle held in the chute, its head immobilized by the mugger of the invention and being administered veterinary medicine.

As shown in FIG. 8, cable 96 is fixed at one end 100 to bracket member 34 and passes in turn over sheave 92, sheave 88, sheave 84, around sheave 64 and is belayed at end 102 to pin 74. Cable 98 is fixed at end 104 to bracket member 36 and passes in turn over sheave 94, sheave 90, sheave 86, around sheave 66 and is belayed at end 106 to pin 74. It will be apparent that movement of piston rod 58 out of the cylinder 56 serves to raise the bracket members 34 and 36 plus the sling 46 vertically upward and that movement of the rod 58 into the cylinder 56 lowers the sling 46. When the rod 58 is fully retracted the sling 46 rests on the ground adjacent the exit gate sections 16 and 18 (see FIG. 6). When the rod 58 is fully extended, the sling wall engage the chin and throat of the head 108 of the cattle 110 (see FIG. 7).

The pin 112 that journals the sheaves 84 and 86 is supported by the lugs 114 and 116 that are fixed to the channel 68. The sheaves 88 and 90 are carried on lever arms 118 and 120 that are pivoted on lugs 122 and 124 fixed to the underside of the channel 68. Springs 126 bias the lever arms 118 and 120 away from the exit gate to take up slack in the cables 96 and 98 as the sling 46 moves between its lowermost and uppermost positions. When the sling is on the ground and the gate sections 16 and 18 are open, the cables 96 and 98 will be tensioned enough the swing lever arms 118 and 120 toward the exit gate. This also occurs when the sling engages the cattle's head 108 placing the cables 96 and 98 under increased tension.

Figure 6:
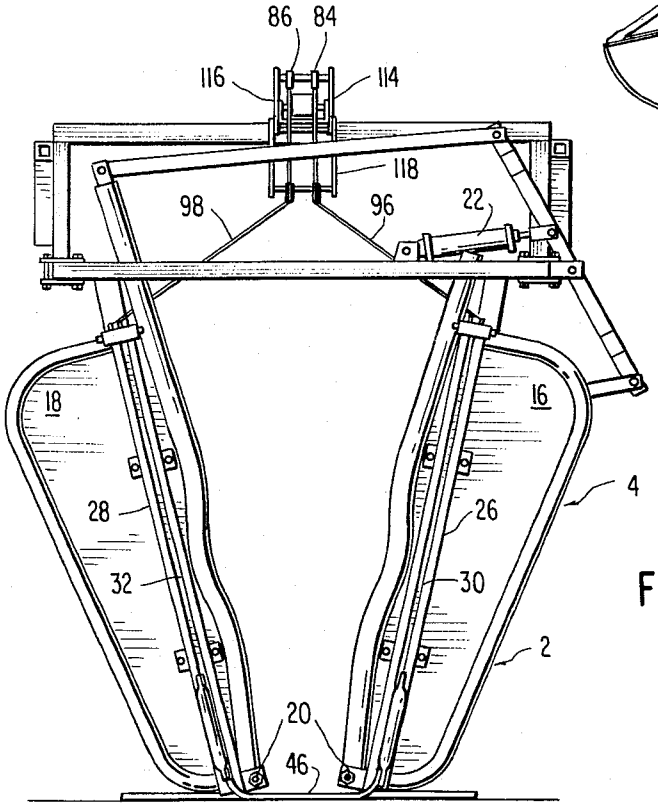
FIG. 6 is an elevational view similar to FIG. 1. but with the animal chute in the opened position.

The mugger of the invention operates as follows. An animal treatment operation begins with the chute open as seen in FIG. 6. The cattle 110 is lead into the chute 4 through the opened gate sections 12 and 14 until the cattle's head 108 extends beyond the exit gate sections 16 and 18. Then the pistons 22 and 24 are pressurized to close the chute. This will bring the chute sides 8 and 10 against the body of the cattle 110 and its head will extend beyond the closed exit gate with the neck of the cattle engaged by the gate sections 16 and 18. Thus, the animal is immobilized except for its head 108. Then, the cylinder 56 will be pressurized to extend the piston rod 58 to lift, as explained above, the sling 46 to engage and immobilize the head 108 of the cattle 110. At this point, the attendant is free to treat the animal, e.g., administer medicinals with a syringe 130. When the animal treatment is completed, the cylinder 56 is depressurized to permit the piston rod 58 to retract and cause the sling 46 to lower until it rests on the ground. Finally, the pistons 22 and 24 are operated to open the chute 4 and the animal leaves the chute 4 thorough the exit gate stepping over the lowered sling 46. Another cattle is then lead into the chute through the entrance gate and the operation is repeated until all necessary animals have been treated. Hence, the new equipment 2 enables the treatment operations to be handled by a single person in contrast to prior operations using the available cattle chutes where one person was required to hold the animal's head while a second person applied the treatent, tag, etc. to the animal.

The embodiments of the invention in which an exclusive property or privilege is claimed are defined as follows:

1. A mugger for use with a cattle chute having moveable sides and pivoted entrance and exit gates to immobilize the head of a cattle held within the chute which comprises:

first and second elongated tubular members, a longitudinal slot in each of said tubular members, means to mount said tubular members vertically on the outside of the exit gate of a cattle chute with said slots facing away from said exit gate, piston means having a free end, means to mount said piston means to reciprocate above said chute, a first pair of sheaves carried by said free end of said piston means, a sheave carried by each of said tubular members adjacent the top ends thereof, a second pair of sheaves, means to mount said second pair of sheaves above said chute and between said exit gate and said piston means, a third pair of sheaves, means to mount said third pair of sheaves above said second pair and between said exit gate and said piston means, a first bracket member structured to slide vertically in said slot of one of said tubular members, a second bracket member structured to slide vertically in said slot of the second of said tubular members, a sling member defined by a front, a rear, a two sides fixed at one side to said first bracket member and fixed at the other side to said second bracket member, a first cable fastened at one end to said first bracket member passing in turn over said tubular member carried sheave, one of said sheaves of said second pair, one of said sheaves of said third pair and over a sheave of said first pair, and a second cable passed in like manner around the second sheaves of said various pairs.

2. The mugger of claim 1 wherein the drape of said sling member slopes downward in the direction toward said tubular members.

3. A mugger for use with an animal chute having moveable sides and pivoted entrance and exit gates to immobilize the head of an animal held within the chute which comprises:

first and second elongated tubular members, a longitudinal slot in each of said tubular members, means to mount said tubular members vertically on the outside of the exit gate of an animal chute with said slots facing away from said exit gate, a first bracket member structured to slide vertically in said slot of one of said tubular members, a second bracket member structured to slide vertically in said slot of the second of said tubular members, a sling member fixed to said bracket members so said sling member may be moved by said bracket members from a position resting on the ground adjacent the exit gate of said animal chute to a elevated position to engage the head of an animal held in said chute, and means to move said bracket members vertically along said tubular members.

4. The mugger of claim 3 wherein said means to move said bracket members comprises a piston.

5. The mugger of claim 4 wherein said piston pulls cables around a plurality of sheaves to move said bracket members.

* * * * *